United States Patent [19]

Wada

[11] Patent Number: 4,848,591

[45] Date of Patent: Jul. 18, 1989

[54] COMMODITY PACKAGE TRANSPORTING/DISCHARGING DEVICE FOR AUTOMATIC VENDING MACHINE

[75] Inventor: Kikuo Wada, Hoya, Japan

[73] Assignee: Daito Manufacturing Co., Ltd., Tokyo, Japan

[21] Appl. No.: 108,381

[22] Filed: Oct. 14, 1987

[30] Foreign Application Priority Data

Jan. 20, 1987 [JP] Japan ..... 62-8998

[51] Int. Cl.[4] ..... G07F 11/02

[52] U.S. Cl. ..... 221/124; 221/130; 221/131; 221/150 A; 221/226; 221/258; 99/323.6; 99/323.7; 99/323.9; 219/10.55 R

[58] Field of Search ..... 221/97, 123, 124, 129, 221/130, 131, 150 R, 150 HC, 150 A, 155, 226, 232, 258, 279, 224; 99/323.5, 323.6, 323.7, 323.9, 327, 332, 357; 219/214, 10.55 R, 10.55 F

[56] References Cited

U.S. PATENT DOCUMENTS

| | | | |
|---|---|---|---|
| 2,590,580 | 3/1952 | Schiavone | 99/323.7 X |
| 2,603,142 | 7/1952 | Miller | 99/323.7 X |
| 2,831,419 | 4/1958 | Timm | 99/327 X |
| 3,160,255 | 12/1964 | Ferraro et al. | 99/332 X |
| 3,180,247 | 4/1965 | Hill | 99/323.9 X |
| 3,335,656 | 8/1967 | Smith | 221/150 HC X |
| 3,442,200 | 5/1969 | Babel | 221/150 HC X |
| 3,620,341 | 11/1971 | Gardner | 221/150 HC X |
| 3,653,541 | 4/1972 | Crum | 221/150 HC |
| 3,866,795 | 2/1975 | Urano | 221/150 HC |
| 4,783,582 | 11/1988 | Wada et al. | 221/150 A X |

FOREIGN PATENT DOCUMENTS

| | | | |
|---|---|---|---|
| 0033800 | 3/1977 | Japan | 221/150 R |

*Primary Examiner*—Joseph J. Rolla
*Assistant Examiner*—Edward S. Ammeen
*Attorney, Agent, or Firm*—Oblon, Fisher, Spivak, McClelland & Maier

[57] ABSTRACT

When a commodity package fed out from a commodity column accommodating a plurality of commodity packages has been accommodated in a package holder of a transporter, the transporter is moved along a guide to transport the commodity package to a position above a heater and is allowed to fall into a receptacle of the heater by the operation of a dropping mechanism. When the commodity in the package has been heated by the heater, the commodity package in the receptacle is fed out up to an opening of the discharging chute and allowed to fall.

10 Claims, 13 Drawing Sheets

COMMODITY PACKAGE TRANSPORTING/DISCHARGING DEVICE FOR AUTOMATIC VENDING MACHINE

BACKGROUND OF THE INVENTION

1. Field of the Invention

This invention relates to a commodity package transporting/discharging device for an automatic vending machine, in which a commodity package taken out from a selected commodity column is transported to a position above a heater by the movement of a transporter and is allowed to fall into a receptacle of the heater, and the commodity package having been heated by the heater is transported to a discharging chute by the movement of the transporter and allowed to fall.

2. Prior Art Statement

In a prior art automatic vending machine with a heater, an microwave heater is usually used as the heating means, and a mechanism for transporting a commodity package to the heater and a mechanism for transporting the commodity package having been heated by the heater to a discharging chute are provided separately.

Therefore, the prior art commodity package transporting/discharging device for an automatic vending machine is complicated not only in structure but also in operation. This means that the device is easily susceptible to mechanical troubles. In addition, it is bulky, and size reduction is difficult.

OBJECT AND SUMMARY OF THE INVENTION

An object of the invention is to provide a commodity package transporting/discharging device for an automatic vending machine, which is simple in construction and reliable in operation.

In order to attain the above object of the invention, there is provided a commodity package transporting-/discharging device for an automatic vending machine, which comprises:

a commodity column group consisting of a plurality of commodity columns laterally juxtaoosed and each capable of accommodating a plurality of commodity packages;

a guide disposed beneath said commodity column group and extending in the direction of juxtaposition of said columns;

a transporter including a package holder movable along said guide by a drive mechanism, and a mechanism for releasing a commodity package held by said package holder;

a heater disposed beneath a path of travel of said package holder and including a receptacle for receiving the commodity package;

a discharging chute having an outlet open at one side of said heater; and an urging section provided on said transporter and capable of engaging the commodity package in said receptacle.

When a commodity package taken out from a commodity column is accommodated in the package holder of the transporter, the transporter is moved along the guide to transport the commodity package to a position above the heater, and then a dropping mechanism is operated to allow the commodity package to fall into the receptacle of the heater. When the commodity in the package has been heated by the heater, the transporter is moved to cause the urging section to urge the commodity package in the receptacle to fall into the discharging chute.

Since transport of the commodity package to the heater and discharge of the commodity package after heating are both effected with a uni-directional movement of the transporter along the guide, the mechanism is simple, and reliable operation can be ensured.

The above and other objects and features of the invention will become more apparent from the following detailed description with reference to the accompanying drawings.

BRIEF DESCRIPTION OF THE DRAWINGS

FIG. 4(*b*) is a perspective view showing the commodity package shown in FIG. 4(*a*) after heating;

DETAILED DESCRIPTION OF THE PREFERRED EMBODIMENT

The drawings illustrate an embodiment of the commodity package transporting/discharging device according to the invention applied to an automatic popcorn vending machine.

Figure 1:
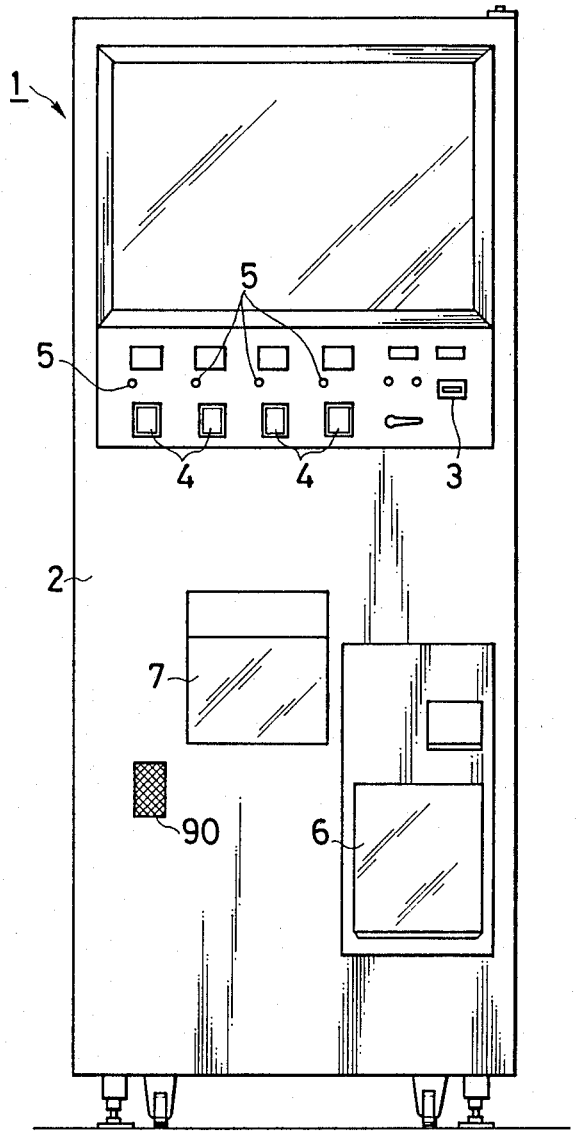
FIG. 1 is a front view showing an embodiment of the automatic vending machine with a commodity package transporting/discharging device according to the invention.
Figure 2:
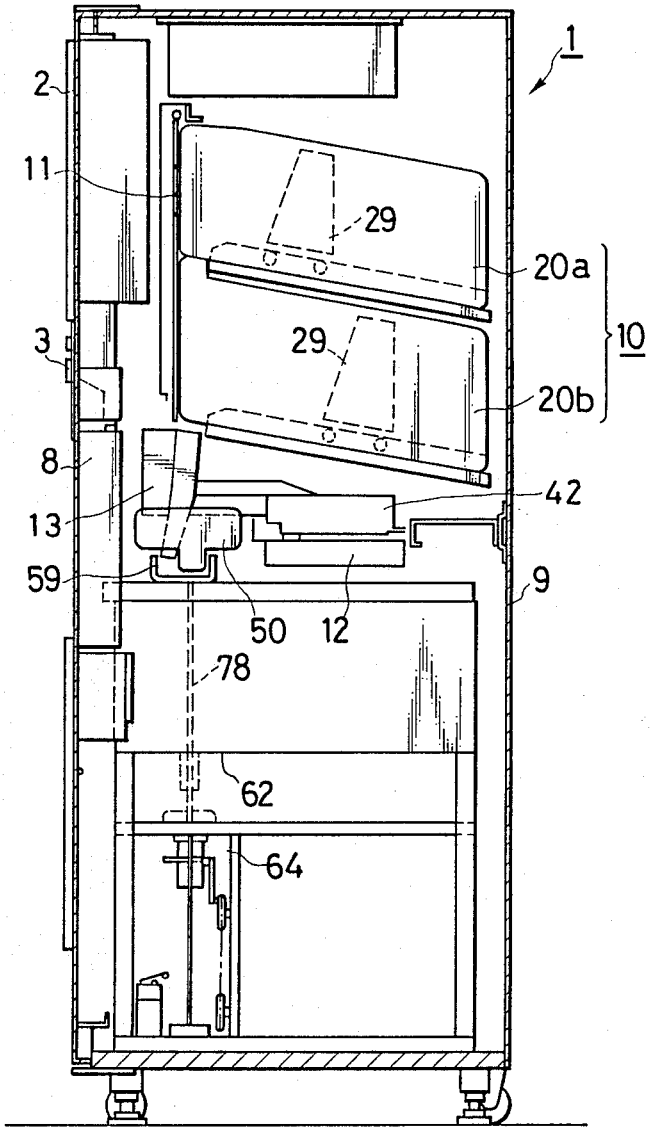
FIG. 2 is a sectional view showing an automatic vending machine according to the invention.

The Figures illustrate an automatic popcorn vending machine 1. As shown in FIG. 1, the machine has a hinged front door 2. The front side of the machine is provided with a coin slot 3, a plurality of commodity selection switches 4, associated sold-out lamps 5, a commodity takeout opening 6 and a window 7 for viewing the state of heating. The rear side of the front door is provided with a coin checker 8 or the like for checking coins inserted through the coin slot 3. In an upper portion of the interior of the machine body 9, there is provided a commodity column group consisting of a plurality of (i.e., four in this embodiment) commodity columns 10 arranged in two lateral rows. Each commodity column can store a plurality of commodity packages. An inner lid 11 is hinged to the front of the column group. Beneath the column group, an elongate guide 12 extends in the direction of juxtaposition of the columns 10. A transporter 13 is provided such that it is movable along the guide 12. Beneath the path of travel of a package holder 14 of the transporter 13 there are provided a 0 heater 15 and an inlet 16' of a discharging chute 16 open at one side of the heater 15.

Figure 4A:
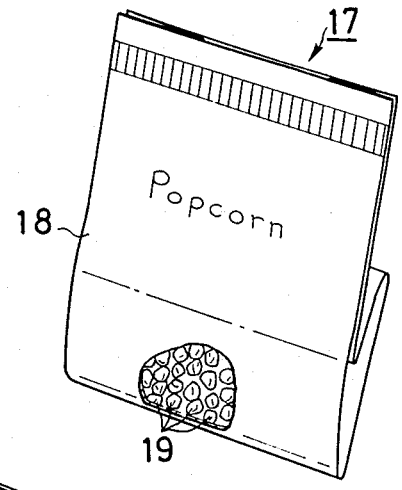
FIG. 4(*a*) is a perspective view showing an embodiment of a commodity package before heating.
Figure 4B:
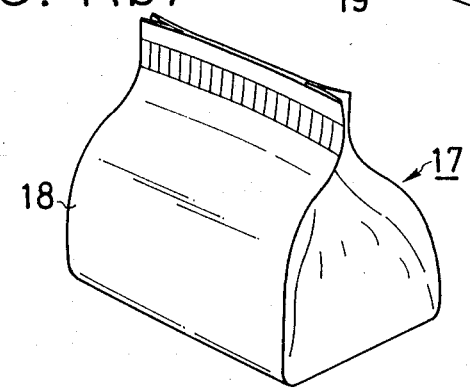

The commodity package 17 consists of a package bag 18 in which corn 19 is sealed together with cooking oil or the like. Before the commodity package is heated, it is held folded as shown in FIG. 4(*a*). When the commodity package 17 is heated, the corn 19 pops and swells as shown in FIG. 4(*b*).

Figure 5:
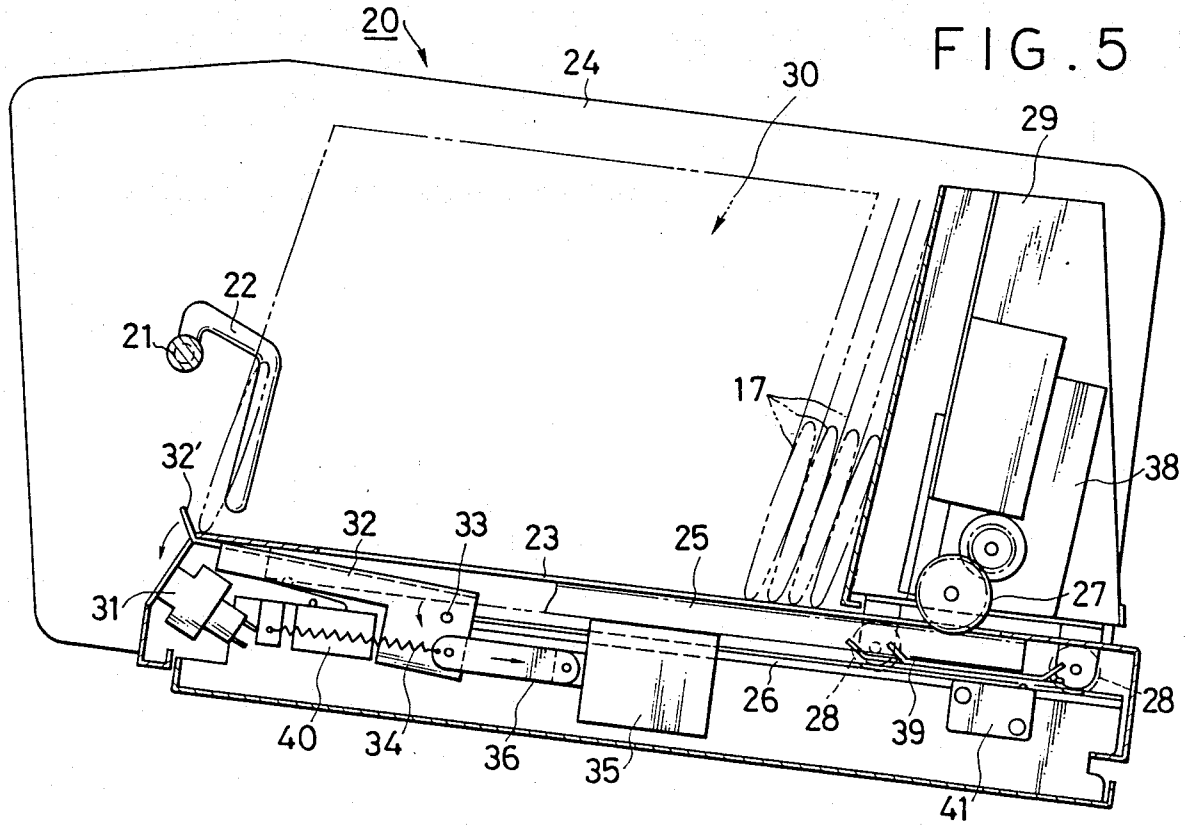
FIG. 5 is an enlarged side sectional view showing a commodity column unit accommodating commodity packages of the automatic vending machine.
Figure 6:
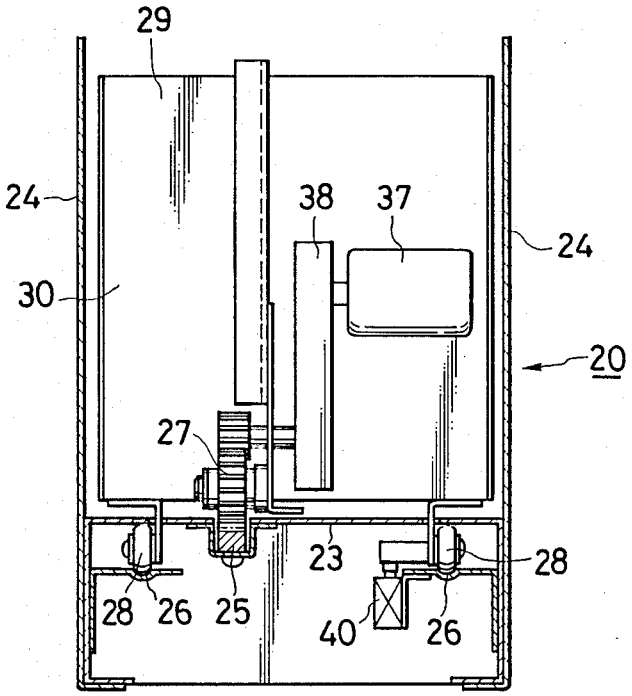
FIG. 6 is a transversal sectional view showing the commodity column unit shown in FIG. 5.
Figure 7:
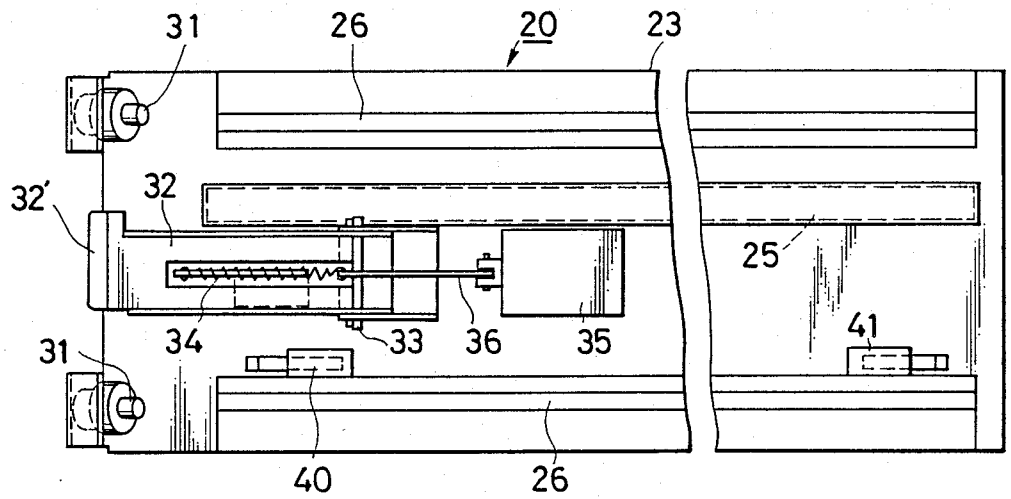
FIG. 7 is a bottom view showing the commodity column unit shown, in FIG. 5.

Each commodity column 10 for storing a plurality of commodity packages 17 consists of upper and lower column units 20*a* and 20*b* . As shown in FIG. 5, a plurality of commodity packages 17 are stored in an upright state, stacked in the thickness direction in each column unit 20. A lateral bar 21 is provided at the outlet of each column unit 20 to prevent turn-down and falling of the first commodity package 17. The lateral bar 21 is supported such that it can fall in a groove 22 and does not constitute an obstacle when replenishing the column unit with commodity packages 17.

The column unit 20 has partition walls 24 extending upright from the opposite sides of a box-like member 23 slightly downwardly inclined toward the rear end (i.e, to the right side of FIG. 5). The top of the box-like member 23 is provided with a feed-out rack gear 25 and a feed-out guide rail 26 exteniing in the lengthwise direction of the box-like member 23. An urging unit 29, which has a feed-out drive gear 27 meshing with the feed-out rack gear 25 and wheels 28 riding on the feed-out guide rail 26, is provided for back-and-forth movement in a storage space 30 defined by the top and opposite side partition walls 24 of the box-like member 23. A feed-out confirmation sensor 31 for sensing the passage of a commodity package 17 is provided at the free end (i.e., left end in FIG. 5) of the box-like member 23. An engagement member 32 for engaging with the foremost commodity package 17 is rotatably mounted on a shaft 33. A spring 34 is connected at one end to a stem portion of the engagement member 32 and at the other end to a connecting rod 36 which is in turn connected to a feed-out solenoid 35. The engagement member 32, as shown in FIG. 5, is spring-biased by the spring 34 such that its upwardly obliquely bent free end portion 32' projects upwardly from the end of the box-like member 23. In this state, the first of the commodity packages 17 stored in the storage space 30 is held with its lower end in engagement with the free end portion 32' of the engagement member 32. When the feed-out solenoid 35 is actuated by a feed-out signal (not shown) from a controller (not shown), the engagement member 32 is rotated in the direction of the arrow in FIG. 5 by the operation of the feed-out solenoid 35, and the end portion 32' is rotated downwards to be accommodated in a lower portion of the box-like member 23. At the same time, the controller supplies a feed-out signal to a drive motor 37 of the urging unit 29 to operate the motor 37. Therefore, the feed-out drive gear 27 is rotated through a speed reducer 38, causing a movement of the urging unit 29 toward the end of the box-like member 23 to push all the commodity packages in the storage space 30 toward the end of the box-like member 23. When the commodity packages 17 are moved by the movement of the urging unit 29, the first commodity package 17 is pushed out to fall down from the end of the box-like member 23. The feed-out confirmation sensor 31 detects the commodity package 17 and supplies a stop signal to the controller. The feed-out confirmation sensor 31 may have any construction so long as it can detect a falling commodity package 17. In this embodiment, the sensor 31 consists of a light-emitting element and a light-receiving element, these elements constituting a so-called reflection type sensor which supplies a signal when the light-receiving element receives light emitted from the light-emitting element and reflected by the commodity package 17.

When the controller has received the signal from the feed-out confirmation sensor 31, it stops the operation of the motor 37 of the urging unit 29 and deactuates the feed-out solenoid 35. When the feed-out solenoid 35 is deactuated, the engagement member 32 is upwardly rotated in the returning direction by the biasing force of the spring 34. As a result, the end portion 32' projects from the end of the box-like member 23 to engage with the first commodity package in the storage space 30. With the movement of the urging unit 29 caused in this way, the commodity packages 17 are progressively fed out. When the number of commodity packages 17 in the storage space 30 runs low, an operating member 39 mounted at the lower end of the urging base 29 acts on a commodity shortage sensor 40 provided in a front portion of the box-like member 23. As a result, a signal is supplied from the commodity shortage sensor 40 to the controller. The rear end position of the urging unit 29 is detected by a full sensor 41 provided at the rear end of the box-like member 23.

Figure 8:
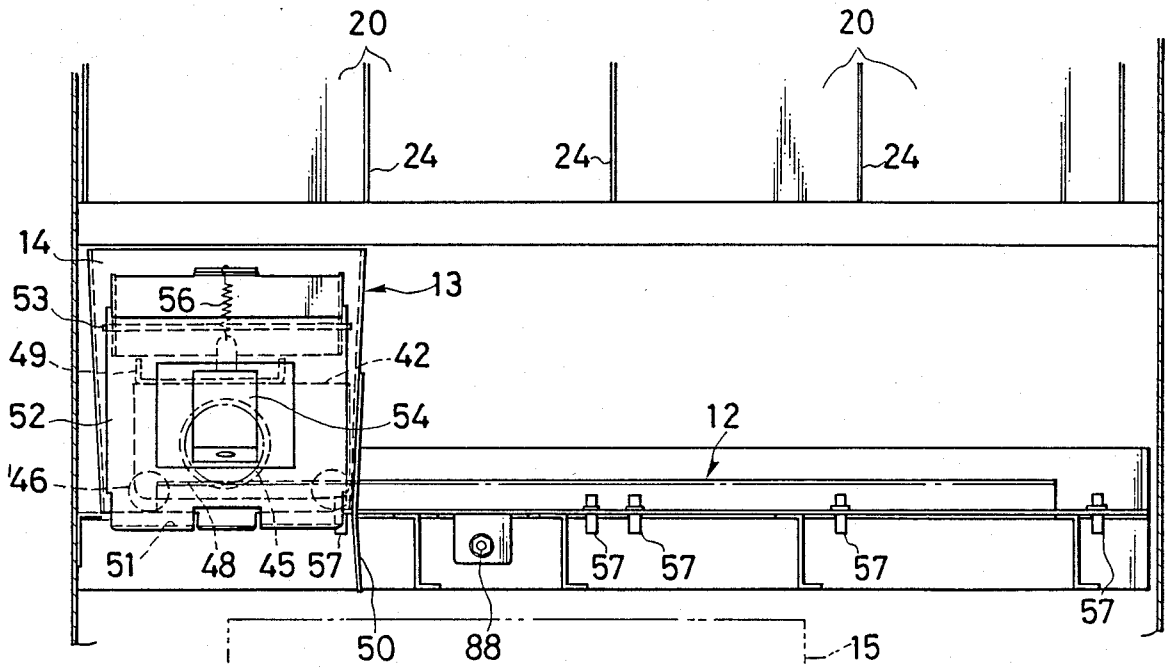
FIG. 8 is a front view showing a commodity package transporter of the automatic vending machine.
Figure 9:
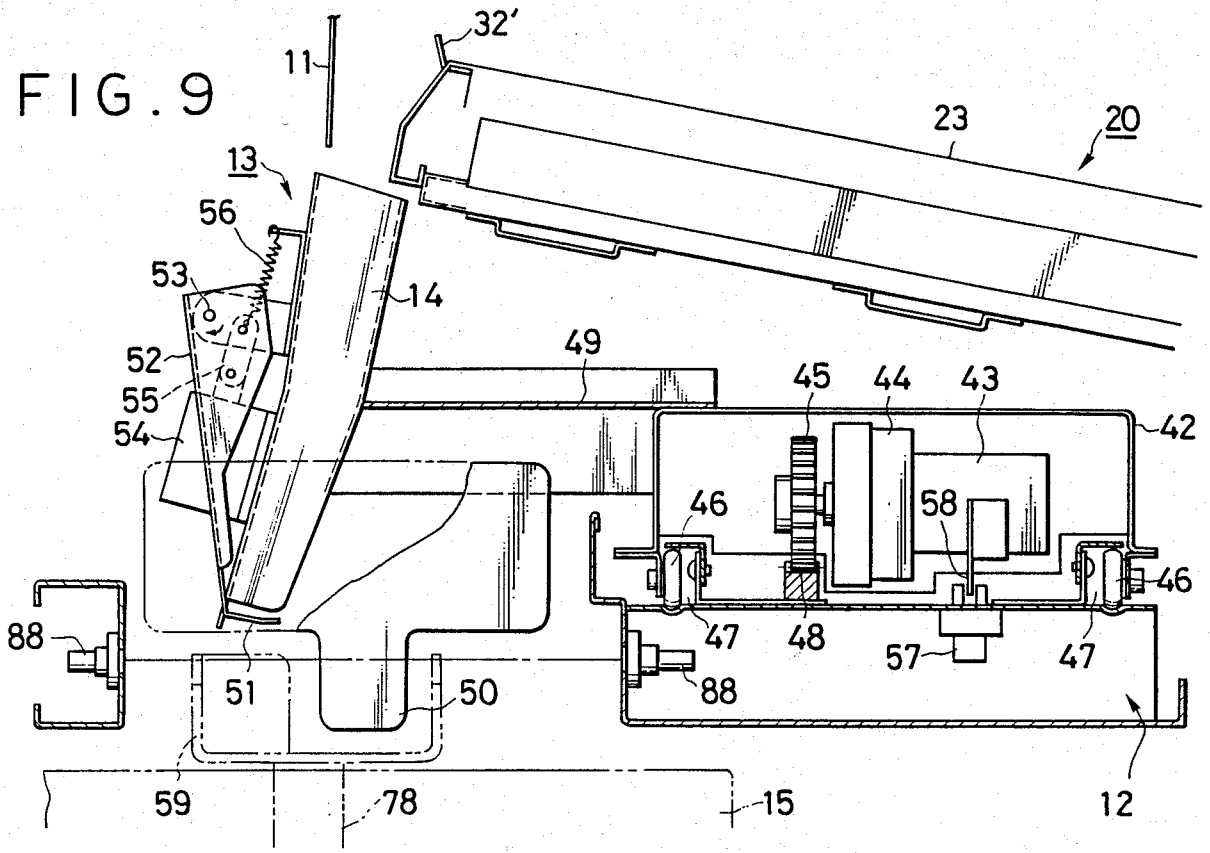
FIG. 9 is a side view, partly in section, showing the transporter shown in FIG. 8.
Figure 10:
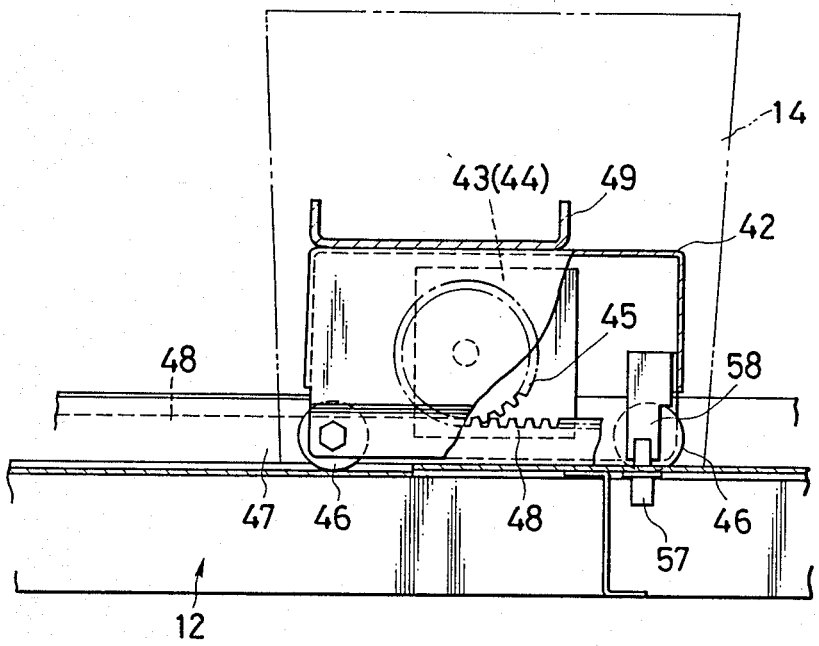
FIG. 10 is a front view, partly broken away, showing the transporter shown in FIG. 8.
Figure 11:
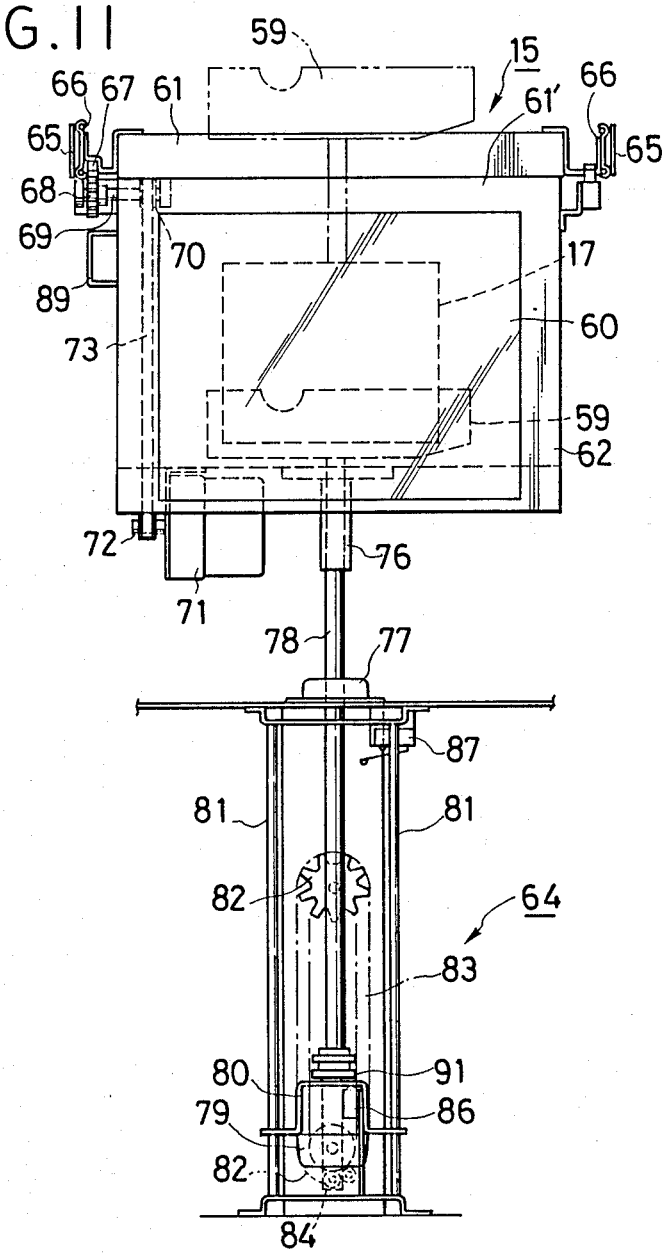
FIG. 11 is a front view showing a heater and a receptacle raising/lowering and rotating mechanism of the automatic vending machine.
Figure 12:
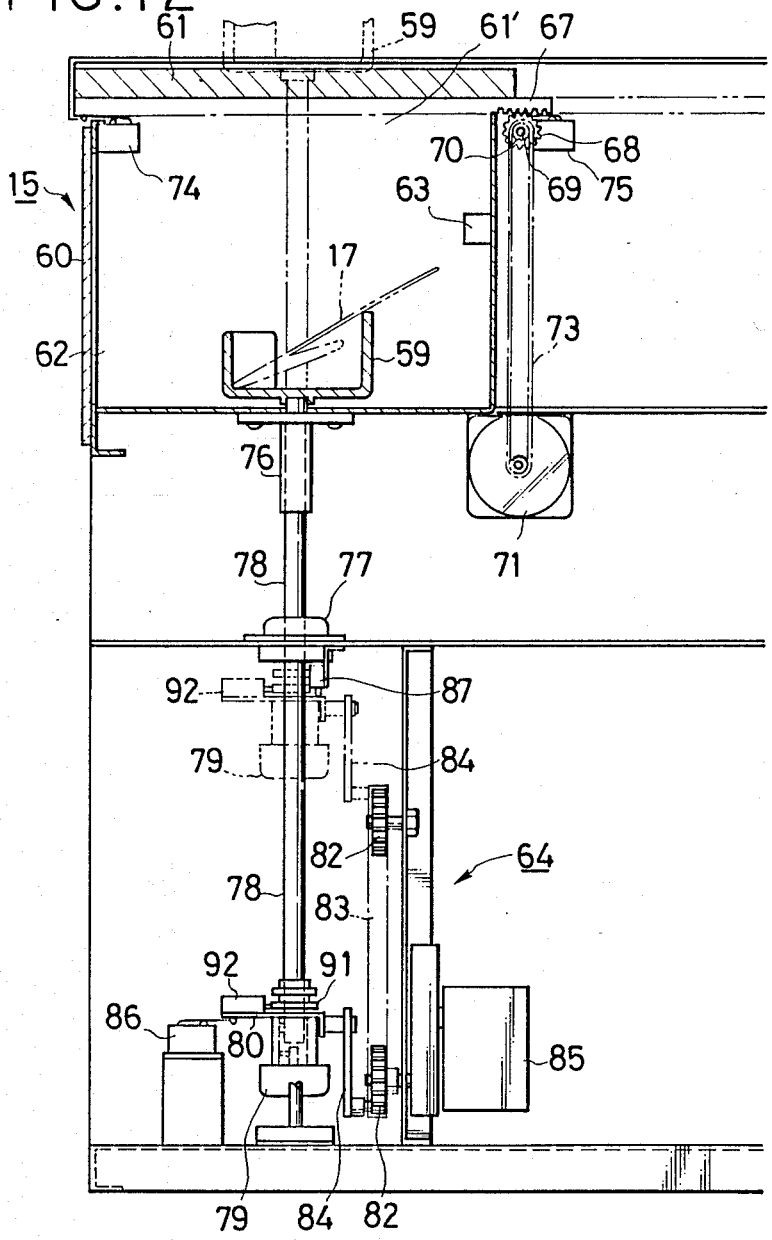
FIG. 12 is a side view, partly in section, showing the heater and receptacle raising/lowering and rotating mechanism shown in FIG. 11.

The transporter 13 for transporting the commodity packages 17 fed out from a commodity column 10 to the heater 15, as shown in FIGS. 8 to 10, has a box-like running base 42 with an inner drive motor 43. The drive motor 43 is provided with a speed reducer 44 whose output shaft has a drive gear 45. The running base 42 has four wheels 46 provided at the bottom and meshing with rail grooves 47 of the guide 12 provided beneath the column group. The drive gear 45 is in mesh with a transport rack gear 48 provided along the rail groove 47. An arm 49 extends forwardly from the running base 42, and the rectangular package holder 14 open at the top and bottom is provided at the free end of the arm 49. One side of the commodity package holder 14 is provided with a T-shaped urging unit 50. At the front of the package holder 14, a support member 52 with a substantially horizontal support section 51 provided at the lower end is mounted rotatably about a pivot 53 so as to serve as a dropping mechanism. A stem of the support member 52 is connected to a connecting rod 55 which is in turn connected to a dropping solenoid 54. The support section 51 of the support member 52 is spring-biased by a spring 56 so that it faces a lower end opening of the package holder 14. The guide 12 is provided with stop position detectors 57 in correspondence to the individual commodity columns 10 and heater 15. A downwardly directed operating plate 58 which can operate the stop position detectors 57 is provided on the running base 42. The stop position detector 57 may be of any construction so long as it can detect the position of the transporter 13. In this embodiment, it has a light-emitting element and a light-receiving element, these elements constituting a photosensor-type detector for supplying a signal when light is interrupted by the operating plate 58 brought to a position between the light-emitting and light-receiving elements. Therefore, when the drive motor 43 is operated by a signal from the controller, the transporter 13 is moved along the guide 12 with the rotation of the drive gear 45 meshing with the transport rack gear 48. When the operating plate 58 acts on a predetermined stop position detector, the controller receives a signal from that stop position detector 57 to stop the operation of the drive motor 43, whereby the top opening of the package holder 14 may be stopped beneath the outlet of the predetermined commodity column 10, i.e., directly beneath the end of the column unit 20 corresponding to the commodity selected by a purchaser by inserting a coin or coins through the coin slot 3 and operating the commodity selection switch 4. When a commodity package 17 is fed out from the column unit 20 in this state, the commodity package 17 is allowed to fall into the package holder 14 to be supported by the support section 51 of the support member 52. The running base 42 is moved by operating the drive motor 43 according to a signal from the controller. When the stop position detector 57 corresponding to the heater 15 detects the running base 42 with the action of the operating plate 58, the controller receiving a signal from that stop position detector 57 stops the operation of the drive motor 43 to stop the transporter 13 at a predetermined position above the heater 15. When the controller actuates the dropping solenoid 54 in this state, the support member 52 is rotated so that the support section 51 moves out of the lower end opening of the package holder 14, so that the commodity package 17 in the package holder 14 falls into a receptacle 59 of the heater 15. When the transporter 13 which has transported the commodity package 17 fed out from the column 10 to the heater 15 has caused the commodity package 17 to fall in the above way, it is moved to a stand-by position on the side (left side in FIG. 8) opposed to the discharging chute 16. As shown in FIGS. 11 and 12, the heater 15 has a window 60 provided at the front, and its top is provided with an opening 61' with an openable cover 61. It includes a heating room 62 with a magnetron 63 provided in the inside, a support shaft 78 penetrating the bottom of the heating room and capable of being rotated and vertically moved by a raising/lowering and rotating mechanism 64 and the receptacle 59 provided at the upper end of the support shaft for supporting a commodity package 17. In the heating room 62, a commodity package 17 supported in the receptacle 59 is heated by irradiating it with high-frequency waves generated by the magnetron 63.

The cover 61 is supported for back-and-forth movement by a slider 66 engaged in cover rails 65 provided on the opposite sides of the top opening 61' of the heating room 62. An opening/closing rack gear 67 provided on the side of the cover 61 is in mesh with an opening/-closing pinion gear 68 on the side of the heating room 62, and an endless belt 73 with a step is passed between a pulley 70 mounted on a shaft 69 of the opening/closing pinion gear 68 and a pulley 72 of an opening/closing drive motor 71. Therefore, when the opening/closing drive motor 71 is driven forwardly, the opening/closing pinion gear 68 is driven forwardly through the belt 73. With this forward driving of the opening/closing pinion gear 68, the opening/closing rack gear 67 is retreated together with the cover 61 to open the top opening 61' of the heating room 62. When the opening/closing drive motor 71 is rotated reversely, the opening/closing pinion gear 68 is reversely driven to cause advance of the cover 61, thus closing the opening 61' of the heating room 62. The top of one side of the heating room 62 is provided with a closure confirmation sensor 74 and an opening confirmation sensor 75. The position of the cover 61 is detected with these sensors 74 and 75. When the cover 61 is advanced or retreated to a predetermined position, the operation of the opening/closing drive motor 71 is stopped.

In the raising/lowering and rotating mechanism 64, the support shaft 78 is supported for rotation and vertical movement in a cylindrical slide bush 76 secured to a lower portion of the heating room 62 and a slide bearing 77 secured to the lateral bar of the machine body 9. The receptacle 59 is made of heat-resistant glass and mounted on the upper end of the support shaft 78. A drive motor 79 is connected to the lower end of the support shaft 78 and mounted on a bracket 80 having opposite side holes through which guide rods 81 are inserted. Upper and lower sprockets 82 are provided beside the guide rods 81, and a chain 83 is passed round both the sprockets 82. The bracket 80 is connected to a piece of the chain 83 through a connection arm 84. A vertical drive motor 85 is connected to the lower one of the sprockets 82.

The receptacle 59 is lowered to the neighborhood of the bottom of the heating room 62 as shown by solid lines in FIG. 12. The bracket 80 is held stationary at a lowered position at which it acts on a lowered position sensor 86. With a signal from the controller, the cover 61 is moved to open the top opening 61' of the heating room 62, and then the vertical drive motor 85 is operated, whereby the chain 83 is driven with the rotation of the sprockets 82, thus raising the bracket 80. In consequence, the receptacle 59 at the upper end of the support shaft 78 is raised. When the receptacle 59 is raised so that it projects upwards from the opening 61' of the heating room 62 as shown by dashed line in FIGS. 11 and 12, the bracket 80 acts on a raised position sensor 87 to stop the operation of the vertical drive motor 85.

When the receptacle 59 is raised up to a position above the heating room 62, the dropping solenoid 54 of the transporter 13 is actuated, causing the commodity package 17 within the package holder 14 to fall down into the receptacle 59. Package sensors 88 are provided above the heating room 62, as shown in FIG. 9. When the sensors 88 confirm falling of the commodity package 17, they supply a signal to the controller. When the controller receives this signal, the vertical drive motor 85 is operated, causing the bracket 80 to be lowered with the rotation of the chain 83. The receptacle 59 is lowered into the heating room 62 with the commodity package 17. When the receptacle 59 has been lowered to a predetermined position, the operation of the vertical drive motor 85 is stopped by a signal from the lowered position sensor 86. Further, with the advance of the cover 61 at this time, the top opening 61' of the heating room 62 is closed.

When the receptacle 59 has been lowered and the cover 61 closes the top opening of the heating room 62, the controller operates the drive motor 79 to cause rotation of the receptacle 59. At the same time, the magnetron 63 is operated to irradiate the rotating commodity package with a high-frequency wave. Thus, the corn 19 in the commodity package 17 is caused to pop, so that the commodity package 17 swells. In this embodiment, the heating room 62 of the heater 15 has the side provided with a duct 89 communicating with the inside, the duct 89 being communicated with an aroma delivery opening 90 of the front door 2. Thus, the aroma at the time of the heating can be discharged to the front of the automatic vending machine 1. Further, the purchaser can confirm through the window 7 of the front door 2 and window 60 of the heater 15 that the commodity package 17 is supplied to the heater 15 and that the commodity package 17 is caused to swell with the popping of the corn 19.

When the corn 19 has popped sufficiently, the operation of the drive motor 79 and magnetron 63 is stopped. The receptacle 59 stops its rotation at a predetermined position by the action of a cam 91 and a sensor 92 mounted at the lower end of the support shaft 78. When heating by the heater 15 has terminated, the opening/-closing drive motor 71 and vertical drive motor 85 are operated by a signal from the controller. Thus, the cover 61 is retracted, the top opening 61' of the heating room 62 is opened, and the receptacle 59 is raised with the commodity package 17.

Figure 3:
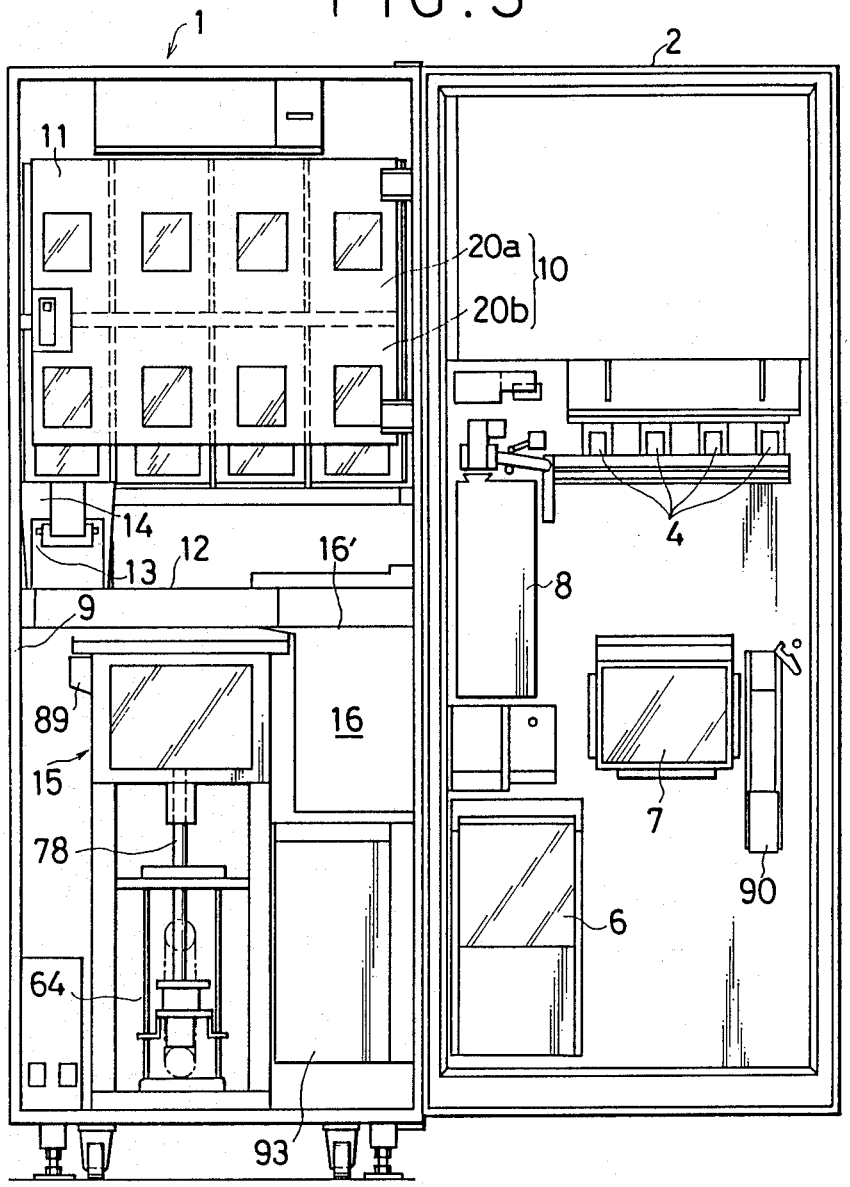
FIG. 3 is a front view showing the automatic vending machine shown in FIG. 1 with a front door opened.

When the receptacle 59 has been raised up to a predetermined height, the transporter 13 is moved by a signal from the controller. With this movement of the transporter 13 the urging unit 50 mounted on one side of the commodity package holder 14 is brought into contact with the side surface of the commodity package 17, thus urging the commodity package 17 in the lateral direction. Thus, the commodity package 17 falls from above the receptacle 59 into the inlet 16' of the sidewise discharging chute 16. It falls along the discharging chute 16 down to a commodity receiving section 93 provided at the lower end of the discharging chute 16 (FIG. 3).

When the commodity package 17 has fallen down to the commodity receiving section 93, the purchaser can take out the commodity package 17 with the cooked popcorn by inserting a hand into the commodity take-out opening 6 of the front door 2.

While the above embodiment is concerned with the heating of corn, this is by no means limitative, and the invention is also applicable to the de-freezing and heating of food, e.g., hamburgers, fried potatoes, hot dogs, lunches, etc.

Figure 13:
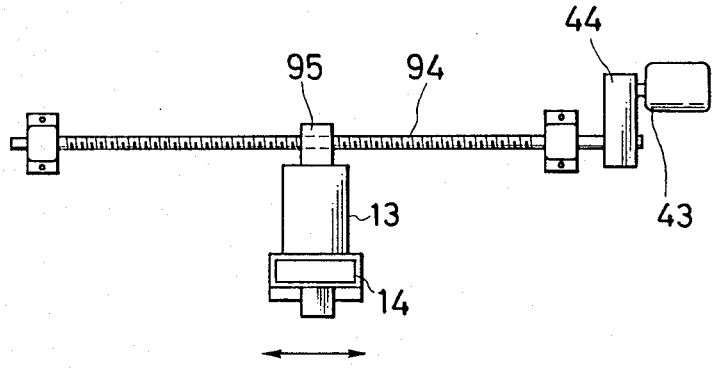
FIG. 13 is a schematic plan view showing a different example of the drive mechanism of the transporter.
Figure 14:
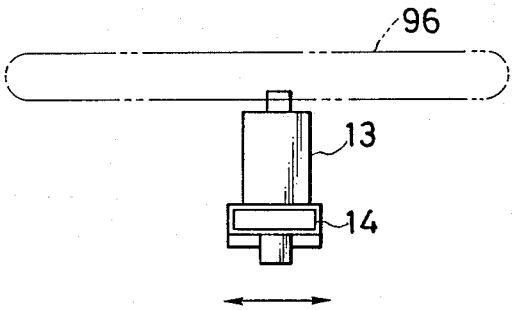
FIG. 14 is a schematic plan view showing a further example of the drive mechanism of the transporter.

Further, the drive mechanism of the transporter 13 according to the invention is not limited to the combination of the rack gear and pinion gear as in the above embodiment, but it may also have any other construction so long as it can drive the transporter 13. FIG. 13 shows a different example of the transporter 13. In this example, a laterally elongate rod 94 with male threads is provided rotatably under the commodity column group, a female screw socket 95 is meshed with the male screw rod 94 and connected to the transporter 13. The male thread rod 94 is rotated by the drive motor 43 to cause movement of the female screw socket 95 in the lateral direction, thereby causing movement of the transporter 13 to a predetermined position. FIG. 14 shows a further example. An endless member 96, e.g., a chain or a belt, is passed below the commodity column group. The transporter 13 is connected to the endless member 96. The endless member 96 is rotated by the drive motor 43, thereby moving the transporter 13. The dropping mechanism provided in the package holder 14 may have any construction so long as it has functions of supporting the commodity package 17 and allowing it to fall.

As has been described in the foregoing, according to the invention by the movement of the transporter in the lateral direction the commodity package can be transported from the commodity column to the heater, and also the commodity package after the heating can be allowed to fall through the discharging chute. Therefore, it is possible to simplify the construction compared with the prior art mechanism. Further, the movement itself is simplified, so that troubles are less liable to occur. Further, it is possible to reduce the distance of transport of commodity packages. Further, the arrangement of the commodity columns and heater can be facilitated, and it is possible to make effective use of the space in the machine body, permit size reduction of the automatic vending machine and increase the commodity package accommodation capacity.

What is claimed is:

1. A commodity package transporting/discharging device for an automatic vending machine, said device comprising:

(a) a commodity column group comprising a plurality of commodity columns laterally juxtaposed and each capable of accommodating a plurality of commodity packages;

(b) a guide disposed beneath said commodity column group and extending in the direction of juxtaposition of said plurality of commodity columns;

(c) a transporter including:

(i) a package holder movable along said guide by a drive mechanism and (ii) a mechanism for releasing a commodity package held by said package holder;

(d) a heater disposed beneath a path of travel of said package holder and including a receptacle for receiving the commodity package;

(e) a discharging chute adjacent one side of said heater, said discharging chute including an outlet opening;

(f) an urging section provided on said transporter and capable of engaging the commodity package in said receptacle; and (g) means for supporting said receptacle so that it can be rotated and vertically moved, (h) a commodity package having fallen from said column group into said package holder being transported to said receptacle of said heater by the movement of said transporter along said guide, and the commodity package after being heated by said heater being engaged with said urging section and allowed to fall into said discharging chute.

2. The commodity package transporting/discharging device according to claim 1 wherein said heater further comprises:

(a) a heating room having a top opening and (b) a magnetron provided in said heating room, (c) said receptacle being supported such that it extends through said top opening to the outside of said heating room.

3. The commodity package transporting/discharging device according to claim 2, wherein said top opening of said heating room is provided with an openable cover.

4. The commodity package transporting/discharging device according to claim 1, wherein said drive mechanism of said transporter is a rack-and-pinion-gear mechanism.

5. The commodity package transporting/discharging device according to claim 1, wherein said drive mechansim of said transporter includes a rod with male threads and a female screw socket meshing with said male threads.

6. The commodity package transporting/discharging device according to claim 1, wherein said drive mechanism of said transporter is an endless belt.

7. A commodity package transporting/discharging device for an automatic vending machine, said device comprising:

(a) a commodity column group comprising a plurality of commodity columns laterally juxtaposed and each capable of accommodating a plurality of commodity packages;

(b) a guide disposed beneath said commodity column group and extending in the direction of juxtaposition of said plurality of commodity columns;

(c) a transporter including:

(i) a package holder movable along said guide by a drive mechanism and (ii) a mechanism for releasing a commodity package held by said package holder;

(d) a heater disposed beneath a path of travel of said package holder and including;

(i) a receptacle for receiving the commodity package;

(ii) a heating room having a top opening; and (iii) a magnetron provided in said heating room, (iv) said receptacle being supported such that it extends through said top opening to the outside of said heating room;

(e) a discharging chute adjacent one side of said heater, said discharging chute including an outlet opening; and (f) an urging section provided on said transporter and capable of engaging the commodity package in said receptacle;

(g) a commodity package having fallen from said column group into said package holder being transported to said receptacles of said heater by the movement of said transporter along said guide, and the commodity package after being heated by said heater being engaged with said urging section and allowed to fall into said discharging chute.

8. The commodity package transporting/discharging device according to claim 7, wherein said drive mechanism of said transporter is a rack-and-pinion-gear mechanism.

9. The commodity package transporting/discharging device according to claim 7, wherein said drive mechanism of said transporter includes a rod with male threads and a female screw socket meshing with said male threads.

10. The commodity package transporting/discharging device according to claim 7, wherein said drive mechanism of said transporter is an endless belt.

* * * * *